US008083618B2

(12) United States Patent
Coscarelli et al.

(10) Patent No.: US 8,083,618 B2
(45) Date of Patent: Dec. 27, 2011

(54) FOOTBALL KICKING APPARATUS

(75) Inventors: Rick Coscarelli, Adrian, MI (US); Ryan Coscarelli, Adrian, MI (US)

(73) Assignee: Kickingfun, LLC., Adrian, MI (US)

( * ) Notice: Subject to any disclaimer, the term of this patent is extended or adjusted under 35 U.S.C. 154(b) by 4 days.

(21) Appl. No.: 12/824,673

(22) Filed: Jun. 28, 2010

(65) Prior Publication Data

US 2011/0021295 A1 Jan. 27, 2011

Related U.S. Application Data

(60) Provisional application No. 61/227,185, filed on Jul. 21, 2009.

(51) Int. Cl.
*A63B 69/00* (2006.01)

(52) U.S. Cl. ..... 473/429

(58) Field of Classification Search ..... 473/429, 473/419, 415, 423, 430; D21/791, 719
See application file for complete search history.

(56) References Cited

U.S. PATENT DOCUMENTS

| | | | | | |
|---|---|---|---|---|---|
| 1,346,083 | A * | 7/1920 | Frank | 211/23 |
| 1,655,599 | A * | 1/1928 | Dolan | 473/423 |
| 1,862,044 | A * | 6/1932 | White | 473/429 |
| 2,521,649 | A * | 9/1950 | Paupa | 473/445 |
| 2,884,250 | A * | 4/1959 | Patterson | 473/423 |
| 2,976,040 | A * | 3/1961 | Bales | 473/429 |
| 3,977,386 | A * | 8/1976 | Meyer | 124/7 |
| 4,350,338 | A * | 9/1982 | May | 473/423 |
| 4,999,603 | A * | 3/1991 | Mele et al. | 340/323 R |
| 5,454,561 | A * | 10/1995 | Smith | 473/429 |
| 2011/0021295 | A1 * | 1/2011 | Coscarelli et al. | 473/429 |

* cited by examiner

*Primary Examiner* — Gene Kim
*Assistant Examiner* — M Chambers
(74) *Attorney, Agent, or Firm* — Gifford, Krass, Sprinkle, Anderson & Citkowski, P.C.

(57) ABSTRACT

A football kicking apparatus having a football and a stand with one end supported by a ground surface and a second end positioned above the ground support surface by a distance greater than the length of the football. The football is positioned within a sling which, in turn, is rotatably mounted about a horizontal axis to the second end of the stand. In practice, a soccer style football kicker kicks the football which, after multiple rotations about the second end of the stand depending upon the force of the kick, will reposition itself for a subsequent kick.

9 Claims, 3 Drawing Sheets

FOOTBALL KICKING APPARATUS

CROSS REFERENCE TO RELATED APPLICATIONS

This application claims priority of U.S. Provisional Patent Application Ser. No. 61/227,185 filed Jul. 21, 2009, which is incorporated herein by reference.

BACKGROUND OF THE INVENTION

I. Field of the Invention

The present invention relates generally to sport devices and, more particularly, to a football kicking apparatus to practice soccer style football kicks.

II. Description of Material Art

In the game of American football, the football kicker is oftentimes one of the most important players on the team. The football kicker not only kicks the ball to the other side during the opening of a half or after a touchdown has been scored, but also scores points by kicking the point after touchdown as well as field goals.

Many modern football kickers use the so-called "soccer style" kick. In the soccer style kick, the kicker moves towards the ball from one side of the ball and kicks the ball from the side with the instep of his or her foot. Such a soccer style kick has proven effective for experienced players.

In order for the football kicker to become proficient in accurately kicking the ball with sufficient distance, the kicker must continually practice his or her kicking skills. In addition, during a football game, football kickers often kick practice kicks along the sidelines in order to warm up in preparation for the actual football kick during the football game.

There have been previously known devices for a football player to practice his or her kick. In one such device, the football is maintained in a substantially vertical position while a holder is positioned on top of the football. The football player then kicks the football into a net positioned in front of a player. After the practice kick, the player retrieves the ball, repositions it on a holder, and then repeats the practice kick.

One disadvantage of these previously known holders and nets for practice kicking is that the ball must be retrieved after every kick and repositioned on the holder in preparation for the subsequent kick. Consequently, it takes a relatively long period of time to retrieve and reposition the ball on the holder for each kick so that only a limited number of practice kicks can be performed in a given time period. This, furthermore, is particularly critical during the play of an actual football game since the football punter and field goal kicker often will share the same net and only one of them can use the net at one time.

SUMMARY OF THE PRESENT INVENTION

The present invention provides a football kicking apparatus which overcomes the above-mentioned disadvantages of the previously known devices.

In brief, the football kicking apparatus of the present invention comprises a football which is preferably, but not necessarily, of regulation size. A stand then has one end supported by a ground support surface and a second end positioned above the ground support surface by a distance greater than the length of the football.

The football is rotatably mounted about a horizontal axis to the second or elevated end of the stand. Although any conventional mechanism may be utilized to rotatably mount the football to the elevated second end of the stand, preferably the football is contained within a sling having a strap which extends outwardly from one end of the football. That outwardly extending end is then rotatably positioned about the second end of the stand. Optionally, a bearing is positioned between the strap and the second end of the stand to facilitate free rotation of the football around the stand.

In practice, the football is positioned so that it depends downwardly from the second end of the stand and in a kicking position. The football kicker than kicks the ball using a soccer style kick which rotatably drives the ball around the second end of the stand a number of times which varies depending upon the force of the football kick. If desired, a counter is mounted to the stand which counts the number of rotations of the football about the second end of the stand and thus provides an indication of the force of the football kick.

The first end of the stand may be supported on the ground support surface in any conventional fashion. For example, it may be embedded in the ground or may be simply supported on the ground by horizontally extending elongated support beams attached to the first end of the stand. Still other means may be used to support the stand on the ground without deviation from the spirit or scope of the invention.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF PREFERRED EMBODIMENTS OF THE PRESENT INVENTION

Figures 1, 2:
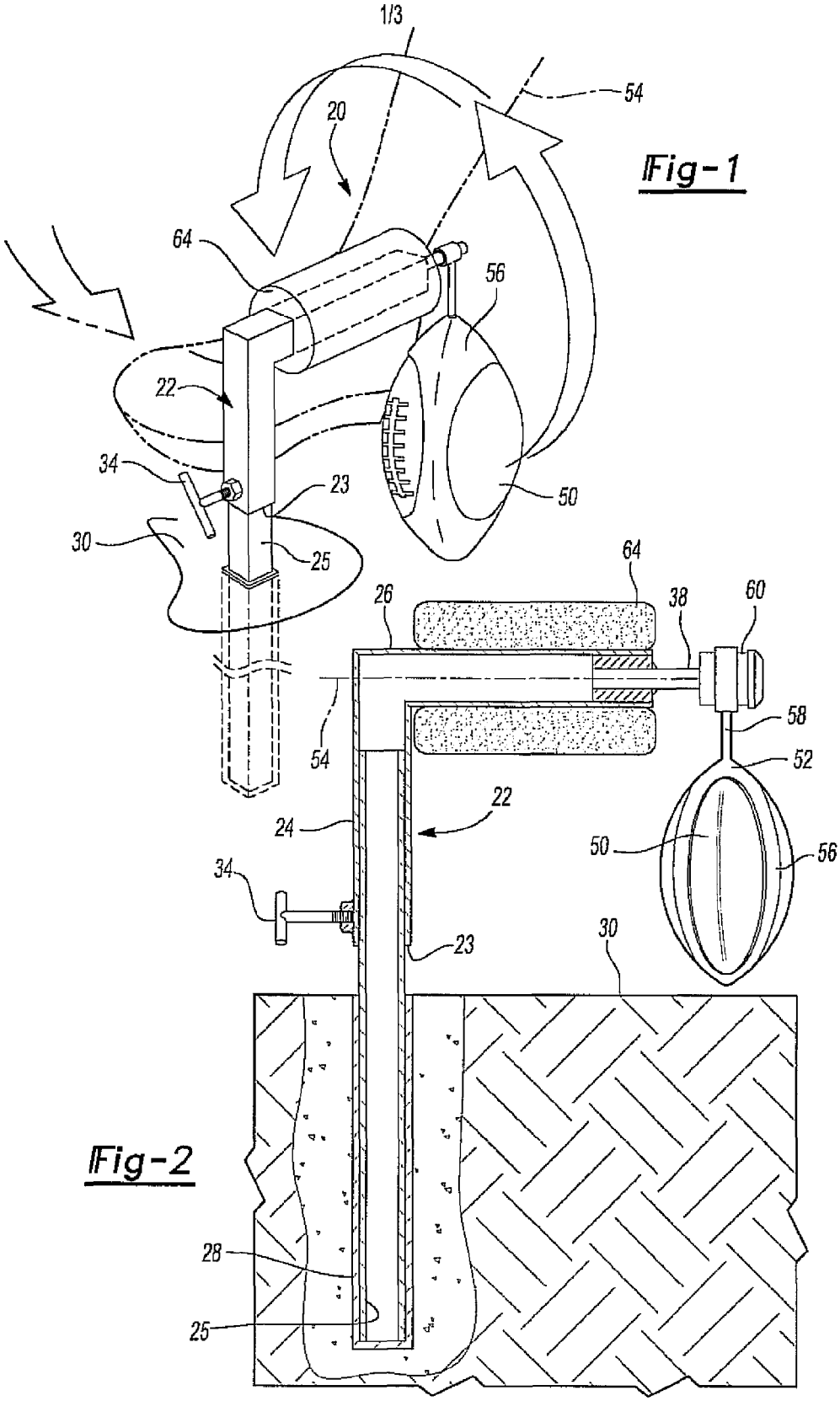
FIG. 1 is an elevational view illustrating a first preferred embodiment of the present invention.
FIG. 2 is a longitudinal sectional view illustrating the first preferred embodiment of the present invention.

With reference first to FIGS. 1 and 2, a preferred embodiment of the football kicking apparatus 20 according to the present invention is shown. The kicking apparatus comprises a stand 22 which is generally L-shaped thus having a first vertical leg 24 open on its bottom 23 and a second horizontal leg 26. The stand 22 may be constructed of any conventional material, such as metal square tubing welded together.

An elongated channel 28 is embedded in a ground support surface 30 so that the channel 28 extends vertically downwardly from the ground support surface 30. This channel 28, furthermore, has an inside diameter dimensioned to slidably receive an elongated rectangular support tube 25 dimensioned so that the support tube extends above the ground 30 and is locked against rotation to the channel 28.

As best shown in FIG. 2, the open bottom 24 of the first leg of the stand is vertically slidably positioned over the upwardly protruding portion of the support tube 25. A locking screw 34 then adjustably secures the leg 24 to the upper end of the support tube 25. This locking screw 34, furthermore, permits a vertical adjustment for the position of the second leg 26 of the stand above the ground.

Figure 3:
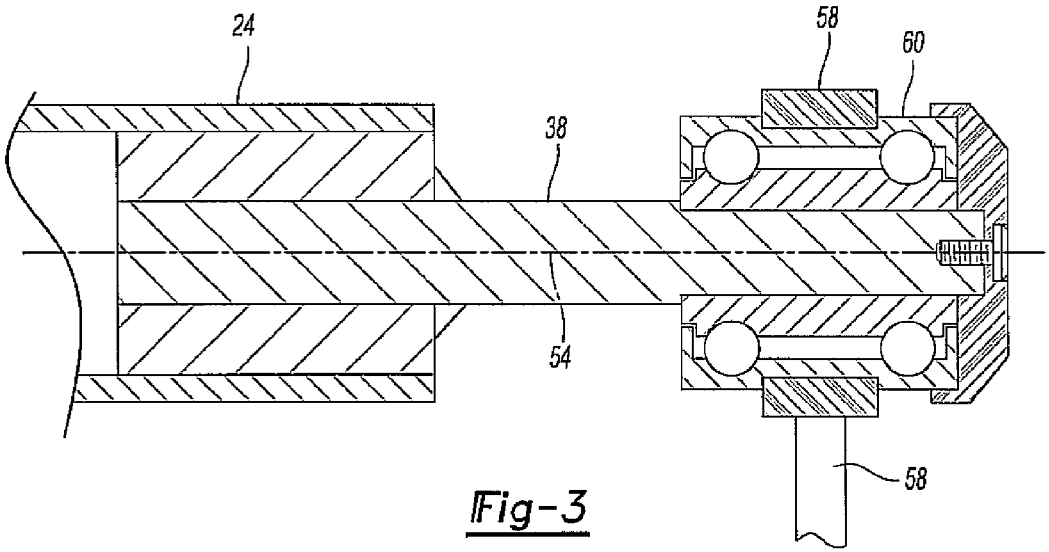
FIG. 3 is a fragmentary view showing a portion of the first preferred embodiment of the invention and enlarged for clarity.

Referring again to FIGS. 1 and 2, the football kicking apparatus further includes a football 50 which is of the American football type, i.e. having two pointed ends 52. One pointed end 52 of the football 50 is rotatably secured to an upper free end 38 of the stand about a horizontal axis 54. Although any means may be utilized to rotatably fasten the end 52 of the football 50 to the end 38 of the stand 22, in the preferred embodiment of the invention, the football 50 is contained within a sling 56 having an upwardly extending strap 58. As shown in FIGS. 2 and 3, the strap 58 is then optionally wound about a rotatable bearing 60 having an outer cylindrical surface which is rotatably mounted to the stand 22 about the axis 54. Consequently, the football 50 together with its associated sling 56 and strap 58 can freely rotate about the axis 54 by any desired number of times depending upon the force of the kick. Alternatively, the bearing can be omitted and the strap 58 simply wound around the free end 38 of the stand.

In practice, the height of the stand 22 is adjusted so that the second end 38 of the stand is positioned above the ground support surface 30 by a distance greater than the length of the football 50 and so that the bottom pointed end 52 of the football rests on or slightly above the ground support surface 30. This adjustment may be used by adjusting the position of the stand 22 relative to the support tube 25 with the adjustment screw 34. The football 50 may then be repeatedly kicked using a soccer style football kick to spin the football 50 and sling 56 around the upper end 38 of the stand 22. The number of times the football 50 will rotate around the second leg 26 of the stand 22 will vary depending on the force of the kick. However, the ball will rapidly slow down and, by gravity, return to a kicking position shown in FIG. 1 not only quickly but without the need for the player to physically position the football 50. As such, practice football kicks may be repeatedly made.

For safety reasons, the second leg 26 of the stand 22 is preferably covered by a protective pad 64.

The football apparatus of the present invention shown in FIGS. 1 and 2 is supported by the ground support surface 30 by the support tube 25 and channel 28. However, any other means may be used to support the stand 22 on the ground support surface 30.

Figure 4:
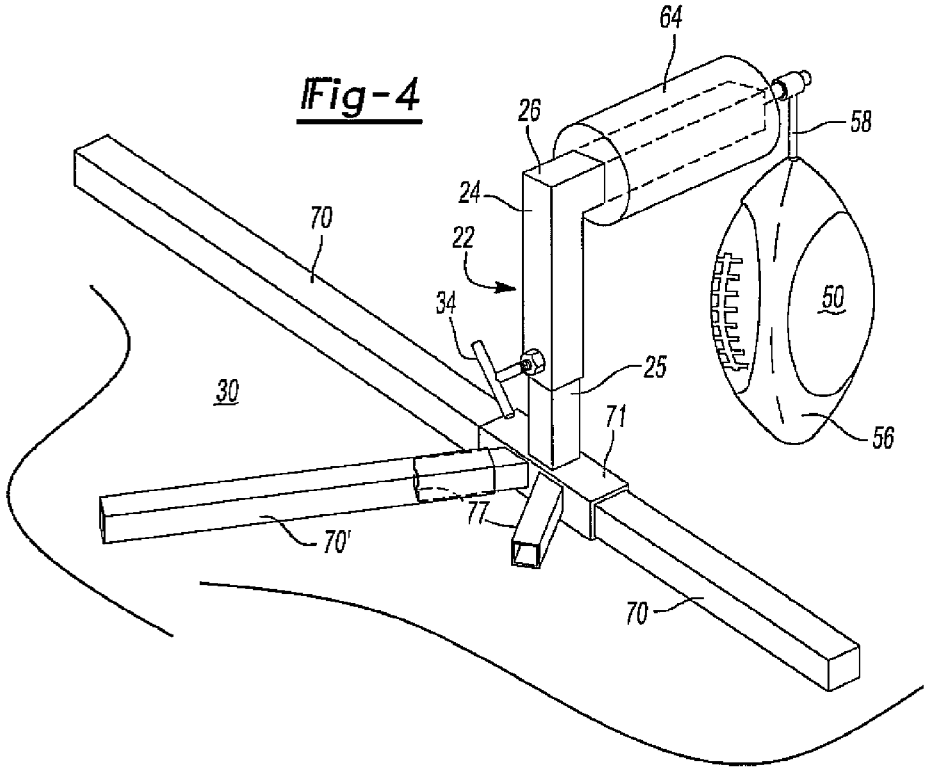
FIG. 4 is a view similar to FIG. 1, but illustrating a second preferred embodiment of the present invention.

For example, as shown in FIG. 4, a plurality of horizontally extending support beams 70 are attached to a hub 71 by any conventional means such that the support beams 70 lie horizontally on the ground support surface 30. The support tube 25 is then secured to and extends vertically upwardly from the hub 71. The first leg 24 of the stand is then slidably positioned over the support tube 25 and locked into position with the screw lock 34 after properly adjusting the height of the second leg 26 of the stand 22.

The football 50 is then secured to the second end 38 of the stand 22 in the previously described fashion and the football is then kicked in the fashion also previously described. One advantage of the second embodiment of the invention illustrated in FIG. 4, however, is that it is portable whereas the first embodiment (FIGS. 1 and 2) is not. The hub 71 may also include two angled sockets 77 which selectively receive a support beam 70' depending on whether the kicker is right or left footed.

Figure 5:
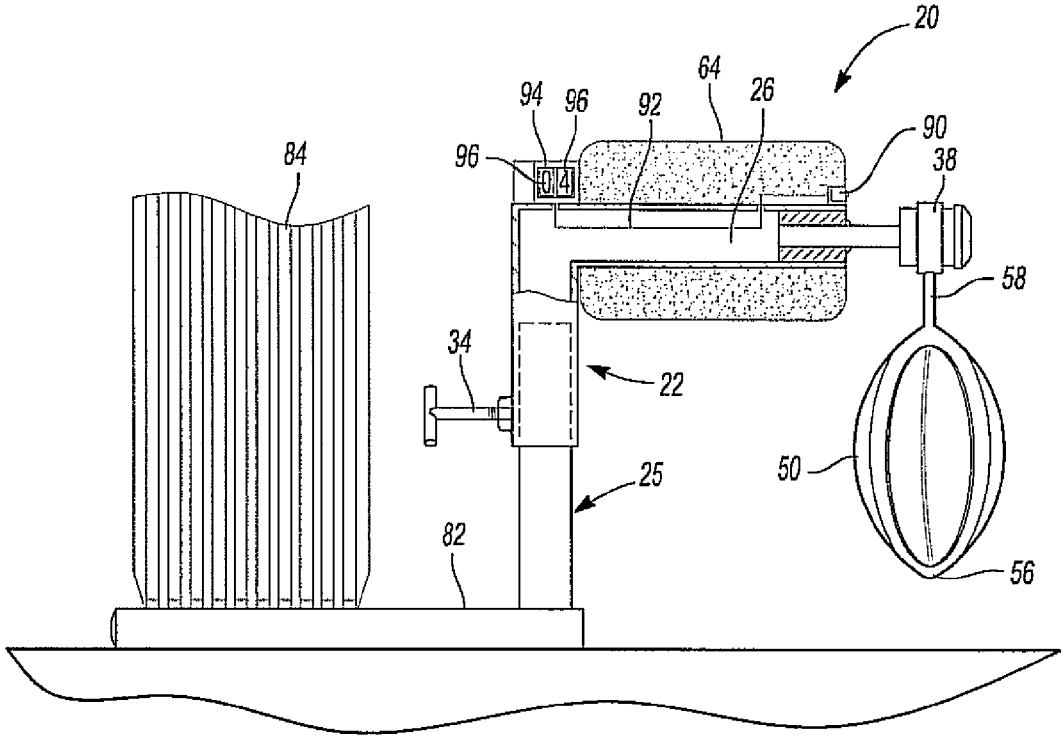
FIG. 5 is a view similar to FIG. 4, but illustrating yet a further preferred embodiment of the present invention.
Figure 6:
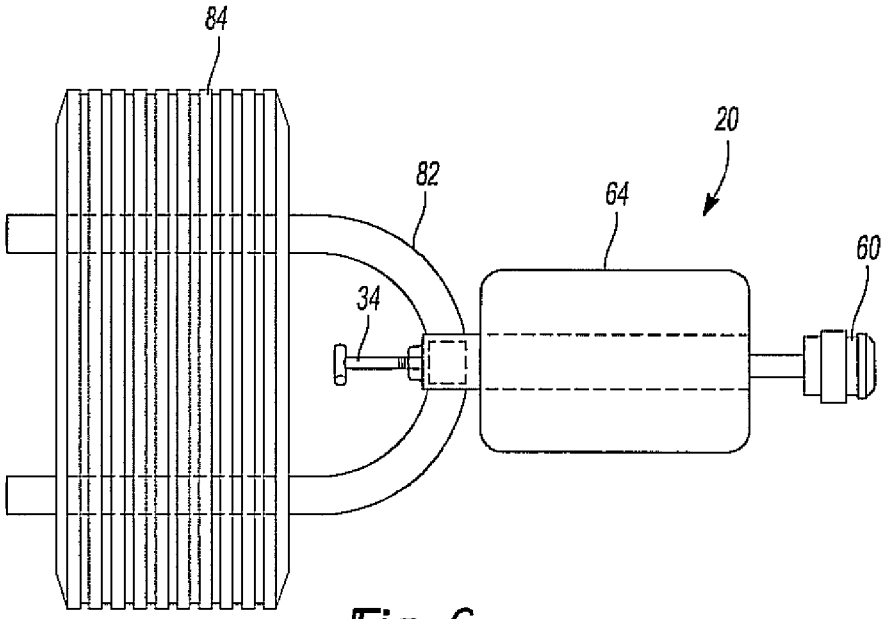
FIG. 6 is a top view of FIG. 5.

With reference now to FIGS. 5 and 6, a still further embodiment of the present invention is shown in which the stand 22 of the football kicking device 20 is mounted to a U-shaped support beam 82 by the support tube 25 which is attached to the support beam 82. As before, the stand 22 is vertically adjustably attached and locked to the support tube 25 by the locking screw 34.

The U-shaped support beam 82 is dimensioned so that a standard sized automotive tire 84 positioned over the parallel legs of the U-shaped support beam 82 would be in contact with each leg and thus hold the support beam 82 firmly to the ground. The embodiment of the invention illustrated in FIG. 5 could be used, for example, at tailgating parties at football stadiums and the like.

Still referring to FIG. 5, unlike the previously described embodiments of the invention, a sensor 90 is mounted to the second leg 26 of the stand 22 adjacent the free end 38 of the stand 22. As such, the sensor 90 is positioned closely adjacent the strap 58 on the sling 56 containing the football 50.

The sensor detects the number of times that the football rotates around the second leg 26 of the stand 22 following a football kick. Any conventional means, such as a Hall effect sensor combined with a magnet on the sling strap 58, a photodiode and/or the like may be used to detect the passage of the strap 58 past the sensor 90 which, in turn, represents one rotation of the football 50.

The sensor 90 generates an output signal on its output line 92 to a counter 94. The counter 94 then counts the number of output signals from the sensor 90 per kick and, after rotation of the football 50 has stopped, activates an indicator 96 which provides an indication of the strength of the kick as represented by the number of rotations of the football 50 around the stand 22. The indicator 96 may be audio, visual and/or the like.

In practice, the provision of the sensor 90 and its associated components which count the number of rotations of the football 50 about the stand 22 would be advantageous for use as a game in which the contestants would vie to kick the ball the hardest. Furthermore, although the counter 94 and indicator 96 are illustrated as mounted to the second leg 26 of the stand 22, in practice the counter 94 and indicator 96 may be mounted anywhere relative to the stand 22 and, in fact, may be completely disconnected from the stand 22 and connected only by the output from the sensor 90.

From the foregoing, it can be seen that the present invention provides a simple and yet effective kicking apparatus for football soccer style kicking. However, having described my invention, many modifications thereto will become apparent to those skilled in the art to which it pertains without deviation from the spirit of the invention as defined by the scope of the appended claims.

We claim:

1. A football kicking apparatus comprising:

a football having two ends, a stand having one end supported by a ground surface and a second end positioned above the ground surface by a distance greater than a length of said football, said football having one end rotatably mounted around a horizontal axis to said second end of said stand, an integrally formed sling having two ends wherein said sling is disposed around and attached to said football, said sling having a plurality of bands which extend around said football and extend between both ends of said football, a portion of said sling being rotatably attached to said second end of said stand, wherein said sling portion comprises a strap, and a bearing having an outer cylindrical surface rotatably mounted about a horizontal axis to said second end of said stand, said strap being disposed around said bearing.

2. The apparatus as defined in claim 1 wherein said stand is generally L-shaped having two elongated legs, one of said legs being slidably mounted over a support tube embedded in the ground surface.

3. The apparatus as defined in claim 2 and comprising an elongated channel embedded in the ground surface, said channel dimensioned to slidably receive said support tube.

4. The apparatus as defined in claim 1 wherein said stand comprises a plurality of elongated and horizontally extending support beams attached to said one end of said stand, said support beams each having a side which flatly abuts against the ground surface.

5. The apparatus as defined in claim 1 wherein said stand comprises a U-shaped support beam attached to said one end of said stand, said U-shaped support beam having spaced apart legs, each spaced apart leg dimensioned to maintain contact with an automotive tire positioned on top of said spaced apart legs.

6. The apparatus as defined in claim 1 wherein said sling is removably attached to said one end of said stand.

7. The apparatus as defined in claim 1 wherein said stand comprises a horizontal beam extending from said second end of said stand, and comprising a pad disposed around said horizontal beam.

8. The apparatus as defined in claim 1 and comprising a counter which counts the number of rotations of said football around said second end of said stand in response to a kick, said counter generating a signal indicative of the magnitude of the count of the counter.

9. The apparatus as defined in claim 8 wherein said signal comprises an audible signal.

* * * * *